United States Patent [19]

Kawakami

[11] Patent Number: 4,754,630

[45] Date of Patent: Jul. 5, 1988

[54] LOCKING DEVICE

[75] Inventor: Mitsuo Kawakami, Nagoya, Japan

[73] Assignee: Kabushiki Kaisha Saikousha, Kasugai, Japan

[21] Appl. No.: 938,826

[22] Filed: Dec. 8, 1986

[30] Foreign Application Priority Data

Dec. 18, 1985 [JP] Japan ..... 60-284602
Feb. 27, 1986 [JP] Japan ..... 61-43629

[51] Int. Cl.[4] ..... E05B 25/00
[52] U.S. Cl. ..... 70/352; 70/378
[58] Field of Search ..... 70/352, 350, 351, 376, 70/377, 378, 387, 392

[56] References Cited

U.S. PATENT DOCUMENTS 211,832 2/1879 Brook et al. ..... 70/352
1,105,161 7/1914 Schaub ..... 70/352
4,287,737 9/1981 Ahn ..... 70/352

*Primary Examiner*—Robert L. Wolfe
*Attorney, Agent, or Firm*—Oblon, Fisher, Spivak, McClelland & Maier

[57] ABSTRACT

A locking device which can be unlocked even in the dark by a simple operation such as inserting a card key, wherein a slit is provided in a casing for receiving the card key, a slider is provided movably inside the casing, a tumbler is inserted movably into the slider and protruding its point into the slit, and an engaging projection is provided on the tumbler. The engaging projection comes into engagement with a groove provided on the bottom of the casing so that the movement of the slider is prevented for completing a locking process. A card key provided with a plurality of holes of different diameters is inserted into the slit for moving the tumbler to an unlocking position, so that the engaging projection is disengaged from the groove to allow the slider to move in a predetermined direction for completing an unlocking process.

8 Claims, 7 Drawing Sheets

LOCKING DEVICE

BACKGROUND OF THE INVENTION (1) Field of Art

The present invention relates to a locking device, in which one ending portion of a wire chain or the like is connected to an ending portion of a casing, another ending portion of the wire chain or the like is provided with a locking element, wherein the locking element is inserted into the casing for locking, on the contrary the locking is released by a key which is provided with a plurality of holes of different diameters.

(2) Prior Art

The conventional locking device in which one ending portion of a wire chain or the like is connected to a casing, the other ending portion of the wire chain or the like is connected to a locking element, generally has the construction of a so-called combination lock, in which a plurality of dial rings each mounted on a cylindrical portion of the casing are rotated in a predetermined combination for unlocking. Accordingly, with conventional combination locking devices, an unlocking operation in the dark takes much trouble or in the worst case, it was almost impossible.

SUMMARY OF THE INVENTION

The object of the present invention is to provide a locking device which can be unlocked easily even in the dark by a simple operation, such as inserting a key. In order to accomplish this object, a locking device according to the present invention includes a slit provided in a casing for receiving a card key provided with a plurality of holes of different diameters, a slider provided movably inside the casing for moving in a predetermined direction upon an unlocking operation, a tumbler inserted movably into the slider and protruding its point into the slit, and an engaging projection provided on the tumbler for coming into engagement with a groove which is provided on the bottom of the casing upon locking to prevent the movement of the slider.

These and other objects and advantages of the invention will become apparent upon reference to the following specification, attendant claims, and drawings.

DETAILED DESCRIPTION OF PREFERRED EMBODIMENTS

Figure 2:
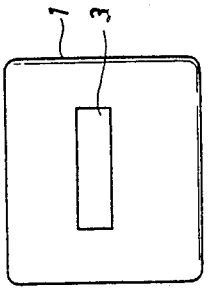
FIG. 2 is a right side view of the first embodiment.
Figure 1:
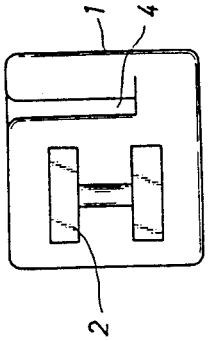
FIG. 1 is a left side view of a first embodiment according to the present invention.
Figure 3:
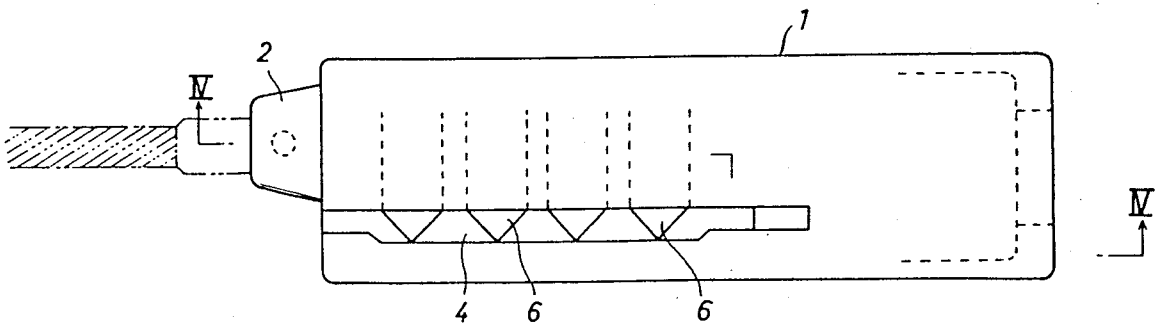
FIG. 3 is a plan view of the first embodiment.
Figure 4:
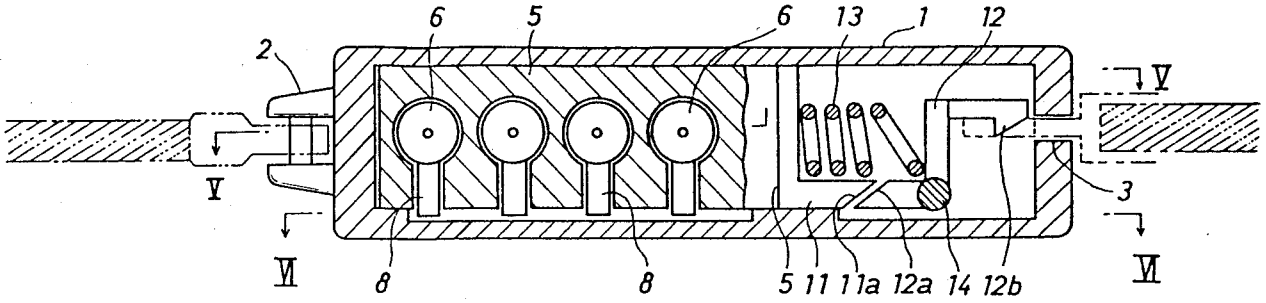
FIG. 4 is a sectional view taken on line IV—IV in FIG. 3.
Figure 5:
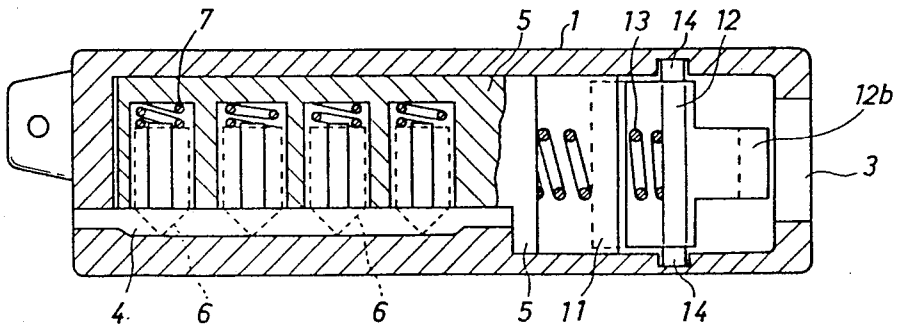
FIG. 5 is a sectional view taken on line V—V in FIG. 4.
Figure 6:
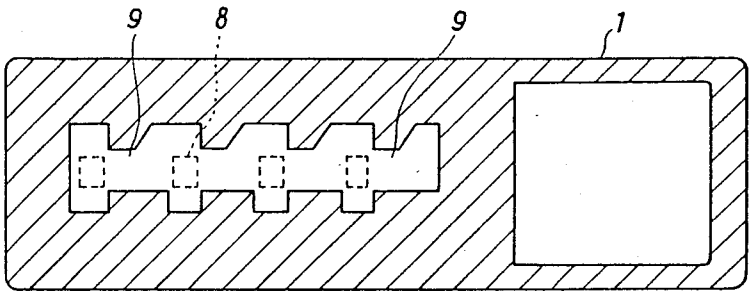
FIG. 6 is a sectional view taken on line VI—VI in FIG. 4.
Figure 7:
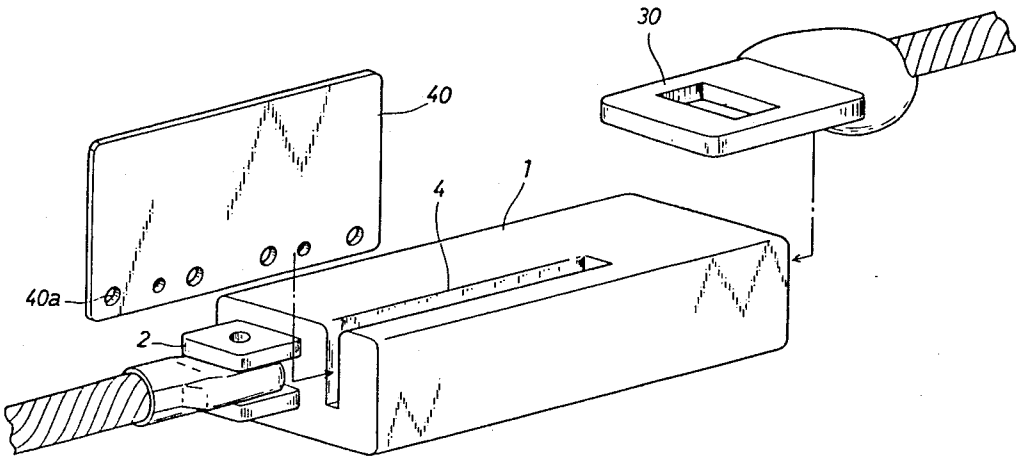
FIG. 7 is a perspective view of the first embodiment.

Four embodiments of the present invention are described in detail below with reference to drawings :

FIG. 1 illustrates a left side view, FIG. 2 illustrates a right side view, and FIG. 3 illustrates a plan view of a first embodiment. A connecting portion 2 is provided on the left side end of a casing 1 in the form of a box for connecting a wire (or a chain), and a entry 3 is provided on the right side end of the casing 1 for receiving a locking element 30 as shown in FIG. 7 mounted on the ending portion of a wire and the like for locking. A slit 4 is provided on the upper part of the casing 1 from the left side end to the center portion in a longitudinal direction for receiving a card key 40 as shown in FIG. 7. Inside a slider 5 provided movably in the right and left directions in the casing 1, four tumblers 6 with a protruding point are received movably in the front and rear directions as shown in FIG. 4, and each tumbler 6 is activated for projecting its point into the slit 4 by force of a coil spring 7 provided in the rear of the tumbler 6 as shown in FIG. 5. An engaging projection 8 is provided on the tumbler 6 slightly protruding downward out of an elongate hole. A groove 9 which is formed at the bottom of the casing 1 as shown in FIG. 6 always receives the ending portion of the engaging projection 8 When each tumbler 6 moves to an unlocking position upon inserting the card key 40, each engagng projection 8 is positioned at the center of the groove 9 as shown in FIG. 6, thereby enabling the slider 5 to move rightward. On the contrary when each tumbler 6 moves to a locking position, the ending portion of at least one engaging projection 8 comes into engagement with a tooth portion of the groove 9, thereby locking the slider 5.

A pushing member 11 which has a tapered portion **11*a* at its ending portion is projected at the right side end of the slider 5, while a hook member 12 is provided facing the pushing member 11 for pivoting about an axis 14. The hook member 12 has an upward tapered portion 12*a* facing the pushing member 11. The hook member 12 also includes a hook 12*b* at its right end facing an entry 3 provided on the casing 1 for latching the locking element 30 inserted through the entry 3. A coil spring 13 provided between the right end of the slider 5 and the hook member 12 activates the slider 5 leftward, while the hook member 12 activates the hook 12*b* to engage the locking element 30. The key 40 is provided with a plurality of holes 40*a* in the card-like structure wherein the holes 40*a* are provided in a position of engagement with the protruding points of the tumblers 6 when the key 40 is inserted into the slit 4 in the casing 1. The combination of the holes 40*a* which can vary, for example, in big holes, small holes or no hole, is determined so that the point of each tumbler 6 comes into engagement with each hole 40***a*, thereby moving each tumbler 6 to an unlocking position. Further the card key 40 can be provided with holes symmetrically about the ordinate and abscissa so that the insertion of the key 40 from any direction can be accepted.

Figure 8:
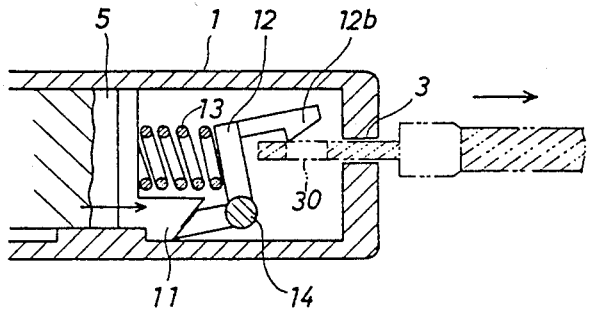
FIG. 8 is a partially sectional view of the first embodiment upon unlocking.
Figure 9:
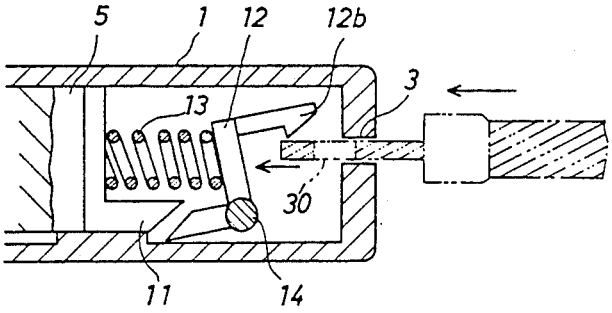
FIG. 9 is a partially sectional view of the first embodiment upon locking.

In the locking device which has the above-mentioned features, upon inserting the locking element 30 attached at the ending portion of a wire and the like into the casing 1 through the entry 3, the locking element 30 moves the hook member 12 and is engaged by the hook 12*b* as shwon in FIG. 9, thereby achieving locking easily and bringing about a locking condition. Upon inserting the card key 40 into the slit 4 in the casing 1, the holes 40*a* provided at the predetermined position move four tumblers 6 to an unlocking position and place the engaging projection 8 at the center of the groove 9, thereby bringing the slider 5 into a movable condition. Upon pushing the key 40 rightward in the above-mentioned condition as shown in FIG. 8, the slider 5 is pushed by the key 40 to move rightward, so that the pushing member 11 pushes the upward taper 12*a* of the hook members 12 to rotate the hook member 12 pivotally about the axis 14 as shown in FIG. 9, thereby disengaging the locking element 30 from the hook 12*b* so that the locking element 30 is puleld out of the casing 1 for completing the unlocking process. Further, it is noted that there can be also another construction wherein the locking device can be unlocked by inserting the key 40 to pass through the casing 1, instead of inserting the key 40 into the slit 4 to stop therein.

Figure 10:
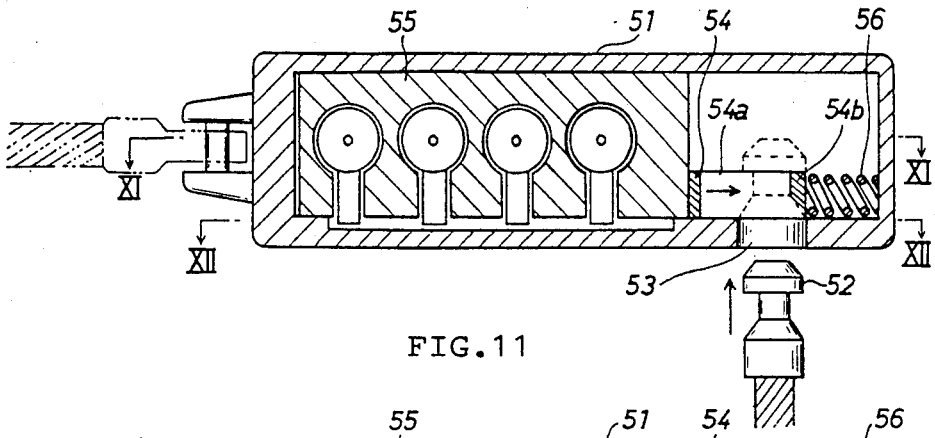
FIG. 10 is a sectional view of a second embodiment according to the present invention.
Figure 11:
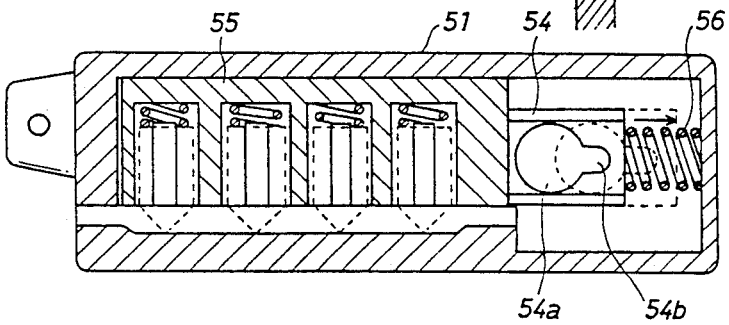
FIG. 11 is a sectional view taken on line XI—XI in FIG. 10.
Figure 12:
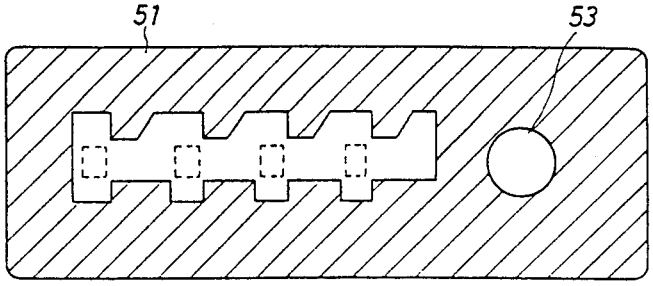
FIG. 12 is a sectional view taken on line XII—XII in FIG. 10.

FIGs. 10, 11 and 12 illustrate a second embodiment wherein a casing 51 has a circular entry 53 at the right bottom thereof for receiving a locking element 52 in a pin shape having a large diameter heading portion (FIG. 10), which comes into engagement with a latching slider 54 provided inside the casing 51 for locking. That is, the latching slider 54 is inserted movably both rightward and leftward at the right side end of a slider 55 provided movably inside the casing 51, while the latching slider 54 is activated leftward correspondingly with the slider 55 by a coil spring 56. The latching slider 54 has a hole 54*a* with a slot which can receive the locking element 52 inserted through the entry 53 in the casing 51 when the latching slider 54 moves rightward, while there is provided a locking portion 54*b*, in the right of the hole 54*a*, which comes into engagement with a small diameter portion under a large diameter heading portion for locking when the latching slider 54 moves leftward. A taper which is provided under the locking portion 54*b* enables the latching slider 54 to move rightward easily against the force of the coil spring 56 upon the insertion of the locking element 52. The other structures of the slider 55, a tumbler, an engaging projection and a groove provided at the bottom of the casing 51 are similar to those in the above-mentioned embodiment.

In the locking device having the aforementioned features, the locking element 52 is inserted into the entry 53 at the bottom of the casing 51 for locking. The detail is hereinafter described. The heading portion of the locking element 52 inserted through the entry 53 into the casing 51, moves the latching slider 54 rightward from the condition shown in FIG. 10 to enter the hole 54*a* so that when the small diameter portion goes over the locking portion 54*b*, the latching slider 54 is moved leftward by the force of the coil spring 56, thereby engaging the locking element 52 with the locking portion 54*b* completely for locking. Similar to the above-mentioned embodiment, upon inserting a card key into a slit in the casing 51, four tumblers move to an unlocking position for bringing the slider 55 into a movable condition. When the slider 55 is pushed rightward by the key in the above-mentioned condition, the latching slider 54 accordingly moves rightward so that the heading portion of the locking element 52 enter the hole 54*a*, thereby disengaging the locking element 52 for unlocking, pulling out the locking element 52 through the entry 53 for completing an unlocking process.

Figure 13:
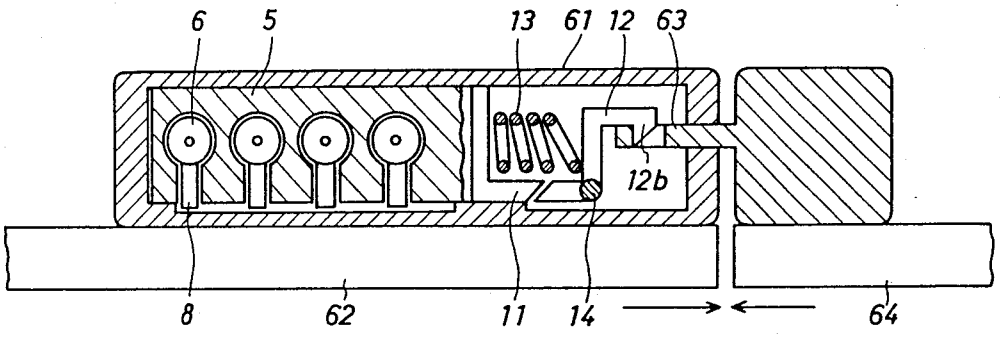
FIG. 13 is a side elevational view of a third embodiment according to the present invention during locking.
Figure 14:
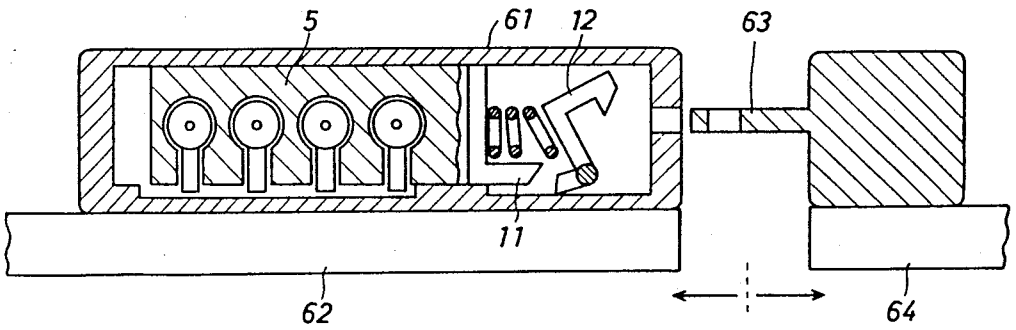
FIG. 14 is a side elevational view of the third embodiment according to the present invention during unlocking.

FIGS. 13 and 14 illustrate a third embodiment of the present invention, which explains the case that the locking device is applied to a sliding door of a building, furniture and the like. A casing 61 in this embodiment is fixed on one sliding door 62 while a slider 5, a tumbler 6, and engaging projection 8, a pushing member 11, a hook member 12 and the like have the structures similar to the first embodiment. A engaging portion 62 is mounted on the other sliding door 64 facing the casing 61 so that when the door is shut, the ending portion of the engaging portion 63 is inserted through an entry to come into engagement with a hook member 12 for bringing about a locking condition. On the unlocking process, similar to the above-mentioned embodiments, when a card key is inserted into the slit in the casing 61 for bringing the slider 5 into a movable condition, the slider 5 is moved rightward by the card key as shown in FIG. 14 so that the hook member 12 is disengaged from the engaging portion 63 for bringing about an unlocking condition.

Figure 15:
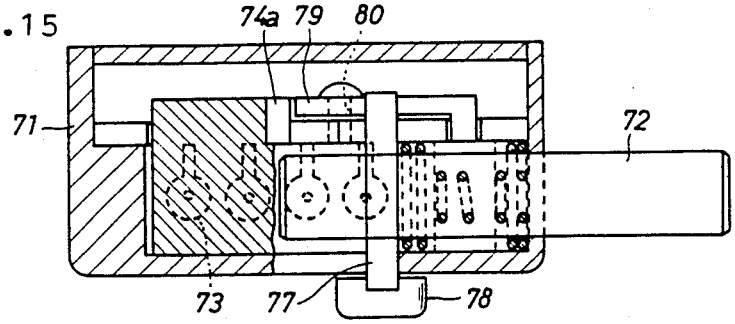
FIG. 15 is a side elevational view, partly in cross section and schematic, of a fourth embodiment according to the present invention when it is used as a bicycle lock.
Figure 16:
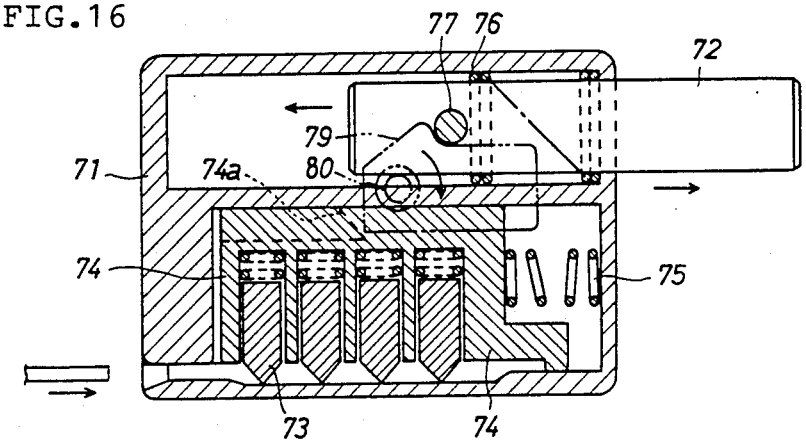
FIG. 16 is a plan view in cross section of the fourth embodiment.
Figure 17:
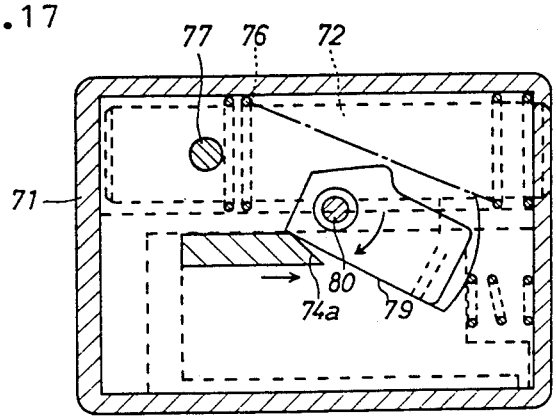
FIG. 17 is a plan view, partly in cross section of the fourth embodiment.

FIGS. 15, 16 and 17 illustrate a fourth embodiment of the present invention, which explains the case that the locking device is applied to a bicycle. The bicycle locking device in this embodiment has a structure wherein a locking element in the form of a bar 72 is projected out of a casing 71 to engage between bicycle spokes for locking, wherein a slider 74 having four tumblers 73 movably is provided movably in the casing 71. Further, though not shown in the drawings of the present embodiment, each tumbler 73 is provided with an engaging projection similar to the first embodiment, a groove provided inside the casing 71 receives an ending portion of the engaging projection and when each tumbler 73 is moved to the unlocking position upon an insertion of a card key, the slider 74 is allowed to move rightward, while in the other locking position the ending portion of at least one engaging projection is inserted in the tooth portion of the groove for locking the slider 74. The slider 74 is activated leftward in FIG. 16 by a coil spring 75, while the bar 72 inserted protrusively into the casing 71 is activated leftward in FIG. 16, i.e. in the direction to which it is pushed back by a coil spring 76 provided on the bar 72. Further, an engaging shaft 77 is provided vertically to the axis of the bar 72 penetrating through one part of the bar 72 inside the casing 71, and an ending portion of the engaging shaft 77 is projecting out of the casing 71 and provided with a knob 78 thereon. A engaging plate 79 supported pivotally about an axis 80 engages with the ending portion of the engaging shaft 77 for locking when the bar 72 is projected to a locking position. The engaging plate 79 is activated counterclockwise in FIG. 16 by a torsion spring or the like (not shown) for stopping in the locking position in FIG. 16. A pushing member 74*a* in the form of a taper provided on a part of the slider 74 moves rightward so that it pushes the engaging plate 79 for rotating clockwise for disengaging the engaging plate 79 from the engaging shaft 77.

In the bicycle lock which has the above-mentioned features, the knob 78 is pushed for projecting the bar 72 in a position shown in FIG. 17 to a position shown in FIGS. 15 and 16 so that the engaging shaft 77 comes into engagement with the engaging plate 79 for locking. On the other hand, in the unlocking process, the card key is inserted into a slit in the casing 71 for moving four tumblers 73 so that the slider 74 is brought in a movable condition for moving rightward. The tapered portion of the pushing member 74*a* on a part of the slider 74 functions for pushing up the ending portion of the engaging plate 79 so that the engaging plate 79 moves clockwise as the arrow shown in FIG. 17 for disengaging the engaging shaft 77 from the engaging plate 79, the bar 72 is moved leftward into the casing 71 by the force of the coil spring 76 for unlocking. Finally, the card key is removed so that the slider 74 moves leftward to a position as shown in FIG. 16 by the force of the coil spring 75, and the engaging plate 79 moves back to a position shown in FIG. 16.

According to the preferred embodiments of the present invention which have been described hereinbefore, the locking device can be unlocked by the insertion of the card key which is provided with a plurality of holes with different diameters so that the unlocking operation is executed more easily than in the case of the conventional locking device with the style of a combination lock even in the dark. Further, if the holes are provided symmetrically about the ordinate and abscissa, the locking device can be unlocked upon the insertion of the card key from any direction so that the unlocking operation can be simplified much more.

While preferred embodiments of the invention have been described using specific terms, such descirption is for illustrative purposes only, and it is to be understood that changes and variations may be made without departing from the spirit or scope of the following claims.

What is claimed is:

1. Locking device for being locked by a card key provided with a plurality of holes, comprising:

a casing having a slit for receiving said card key therein;

a slider provided movably inside said casing for moving in a predetermined direction upon an unlocking operation;

means for disengaging from a locking element engaged therewith upon movement of said slider;

a tumbler movably held in said slider and having a point protruding into said slit (5); and an engaging projection provided on said tumbler and positioned for coming into engagement with a groove upon locking, said groove being provided on a portion of said casing in facing opposition to said engaging projection, thereby preventing the movement of said slider.

2. Locking device according to claim 1 wherein said means for disengaging includes a pushing member connected to said slider, a hook member facing said pushing member and supported for pivoting about an axis connected to said casing.

3. Locking device according to claim 2, wherein said hook member has a first tapered portion and said pushing member has a second tapered portion.

4. Locking device according to claim 2, wherein said hook member has a hook extending therefrom, said hook member being able to come into engagement with a hole of said locking element.

5. Locking device according to claim 1, wherein said means for disengaging includes a latching slider responsive to said slider.

6. Locking device according to claim 1, including the locking element being inserted into an entry of said casing.

7. Locking device according to claim 6, wherein said means for disengaging includes said latching slider having a hole with a slot which receives said locking element and having a locking portion which comes into engagement with a small diameter portion of said locking element.

8. Locking device according to claim 1, including the locking element comprising a bar inserted protrusively into said casing, activated by a coil spring and having an engaging shaft provided transverse to an axis of said bar, said bar being biased out of said casing by a coil spring and being provided with a knob thereon, wherein said means for disengaging comprises an engaging plate supported pivotally about an axis and engaged with said engaging shaft.

* * * * *